US006502744B1

(12) United States Patent
Lorusso

(10) Patent No.: US 6,502,744 B1
(45) Date of Patent: Jan. 7, 2003

(54) FOLDING LAMINATED CONTAINERS

(75) Inventor: Jennifer Lorusso, Brooklyn, NY (US)

(73) Assignee: Ply Design Inc., Brooklyn, NY (US)

( * ) Notice: Subject to any disclaimer, the term of this patent is extended or adjusted under 35 U.S.C. 154(b) by 0 days.

(21) Appl. No.: 09/903,045

(22) Filed: Jul. 11, 2001

(51) Int. Cl.[7] ..... B65D 3/22; B65D 5/62

(52) U.S. Cl. ..... 229/199; 190/127; 220/62.11; 229/198.1

(58) Field of Search ..... 229/5.81, 5.84, 229/103, 198.1, 199, 199.1; 220/62.11, 62.13; 383/119; 190/127

(56) References Cited

U.S. PATENT DOCUMENTS

| | | | | | |
|---|---|---|---|---|---|
| 241,254 | A | | 5/1881 | Udell | |
| 726,698 | A | | 4/1903 | Kerr | |
| 798,264 | A | | 8/1905 | Carrier | |
| 1,363,984 | A | * | 12/1920 | Leiman | 229/199 |
| 1,833,469 | A | * | 11/1931 | Myers | 229/198.1 |
| 2,006,811 | A | | 7/1935 | Mersbach | |
| 2,144,318 | A | * | 1/1939 | Kryder | 220/6 |
| 2,200,320 | A | * | 5/1940 | Zalkind | 229/199 |
| 2,792,981 | A | * | 5/1957 | Grammer | 229/198.1 |
| 2,831,624 | A | | 4/1958 | Lever | |
| 2,872,753 | A | | 2/1959 | Fenton | |
| 3,097,782 | A | | 7/1963 | Koropatkin et al. | |
| 3,119,494 | A | | 1/1964 | Rosenstiel | |
| 3,150,812 | A | | 9/1964 | Sabol | |
| 3,302,848 | A | * | 2/1967 | Elmendorf | 229/199.1 |
| 4,509,645 | A | * | 4/1985 | Hotta | 229/126 |
| 4,790,714 | A | | 12/1988 | Schnapp | |
| 5,000,717 | A | | 3/1991 | Pfeiffer | |
| 5,000,726 | A | | 3/1991 | Dimon | |
| 5,230,689 | A | | 7/1993 | Derby | |
| 5,323,922 | A | * | 6/1994 | Lapoint, Jr. et al. | 383/119 |
| D358,936 | S | | 6/1995 | Wagaman, III | |
| 5,562,228 | A | * | 10/1996 | Ericson | 229/117.07 |

* cited by examiner

*Primary Examiner*—Gary E. Elkins
(74) *Attorney, Agent, or Firm*—Notaro & Michalos P.C.

(57) ABSTRACT

A collapsible container is formed by folding a twolayer blank having a unitary flexible layer and a separated rigid layer into a shape determined by the number of side panels of the blank. The container is held in the assembled position by fastened corresponding pairs of fasteners on adjacent side panels. The flexible and rigid layers are joined together by lamination and/or stitching. The containers are reversible, so that either the rigid or flexible layer may be exposed on the outside of the assembled container.

20 Claims, 4 Drawing Sheets

34
50
32
52
60
10
30
30
25
25
60
20
52
50
32
34
30
34
32
52
50

34
32
70
10
27
30a
70
70
20a
30c
34
32
30b
32
34

FOLDING LAMINATED CONTAINERS

FIELD AND BACKGROUND OF THE INVENTION

The present invention relates generally to the field of collapsible containers and in particular to a new and useful folding container formed from conjoined rigid and flexible layers for holding solid items.

Collapsible or knockdown trays and boxes and other containers are useful for temporarily holding a variety of items. Collapsible trays and boxes are more easily stored than fixed-panel containers since they can take up less space. At the same time, when assembled, some collapsible containers can have comparable strength to fixed, rigid containers.

Materials known for use in making collapsible containers include paper materials in particular, such as cardboard, cardstock and coated papers.

Multi-layer paneled containers are generally disclosed in the art, such as by U.S. Pat. No. 5,230,689 for a flexible container for holding flowable materials. The patent teaches forming the walls of the container by removably inserting a rigid panel inside pockets created by two flexible layers. The rigid panels are not fixed in the pockets. The patent does not disclose what material is used to make the flexible or rigid layers.

Other patents disclose folding containers, such as U.S. Pat. No. 241,254 for a folding tray having a base panel, two side panels and two end panels. The side panels include end projections which fold over the adjacent end panel when the tray is assembled. The patent discloses that it is known to secure the end projections using wire staples, tacks, eyelets. The tray uses an adhesive on a strip of wood veneer, paper or fabric secured to the end panels to hold the end projections in place. The tray may be made of a thin wood veneer or pasteboard.

A tray made by folding a flexible sheet is disclosed by U.S. Pat. No. 798,264. A pie-shaped unitary blank has scored corner sections for folding up side panels of the blank to form a pie-shaped tray. The rear wall of the blank is slit so that the panel may be folded up to form the curved wall. The corners of the folded blank may be secured using glue applied to the folds of the corners.

U.S. Pat. No. 2,006,811 discloses a triangular cardboard blank for folding into an ash tray. The side panels of the ash tray fold upwardly and tabs and corresponding slots in the corners of the ashtray are used to secure the tray in the assembled position. The cardboard may be coated with a flame-resistant ink.

A collapsible lunch bag having snap fasteners for holding the bag in an assembled position is taught by U.S. Pat. No. 2,831,624. The corners of a unitary rectangular blank are creased along diagonals between side and end panels, folded along the creases, and folded over end panels. The end panel has one half of a snap fastener, while one of the folded corners has a corresponding snap and the other corner has apertures for permitting the snap halves to connect. The lunch bag is made of a flexible paperboard or plastic.

U.S. Pat. No. 4,790,714 discloses a collapsible toy box which can be made of cardboard or a plastic. The box is made of a single layer only.

U.S. Patent Des. 358,936 illustrates the design of an antenna tool kit having a triangular shape with folded over top edges which can be secured to the sides of the kit by snap connectors. The kit has a very sharp triangular shape, with straight sides which are joined together along a majority of the length of their adjacent edges.

The prior known collapsible containers primarily rely upon paperboard or pasteboard as the supporting layer for the container. In some cases, the paperboard is coated with a protective layer. None of the prior collapsible containers includes multiple layers of different rigidity but similar thicknesses.

SUMMARY OF THE INVENTION

It is an object of the present invention to provide a collapsible container having rigid connected panels which are easily folded and secured in an assembled position.

It is a further object of the invention to provide a collapsible container having two different exposed surface layers which may be assembled with either layer on the outside of the container.

Accordingly, a collapsible container is provided having a generally planar blank formed from two layers of different materials laminated and sewn together. The two layers are a flexible layer and a rigid or semi-rigid layer. Each blank has a base panel and at least three side panels. Both the blank and the base panel have a general shape with a number of sides corresponding to the number of side panels; that is, a blank with three side panels will have a generally triangular shaped base panel and blank, while a blank with four side panels will have a generally rectangular shaped base panel and blank.

The flexible layer of the blank is a single piece which includes each of the side panels and the base panel, so that joints between the adjacent edges of the side panels are formed with the base panel in the flexible layer. The other edges of the side panels are not connected to any other panel.

The rigid or semi-rigid layer is not composed of a single, unitary piece, but, rather, separate pieces shaped the same as each side and base panel. The separate rigid pieces are laminated and sewn to the appropriate panel of the flexible layer.

A container may be assembled from a blank of the invention by folding the side panels up so that adjacent panel corners overlap each other. The corners are secured to each other.

The sides of the containers are not air-tight, but are sufficiently rigid to hold the shape of the container when solid objects are placed in the container. The containers tend to have a rounded appearance resulting from the connection between the sides. The upper and lower edges of the side panels and the edges of the base panel may each be rounded as well, further enhancing the rounded appearance. While it is preferred that the flexible layer is on the inside of the assembled container, due to the rigid layer being discontinuous at the joints, the blanks are reversible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
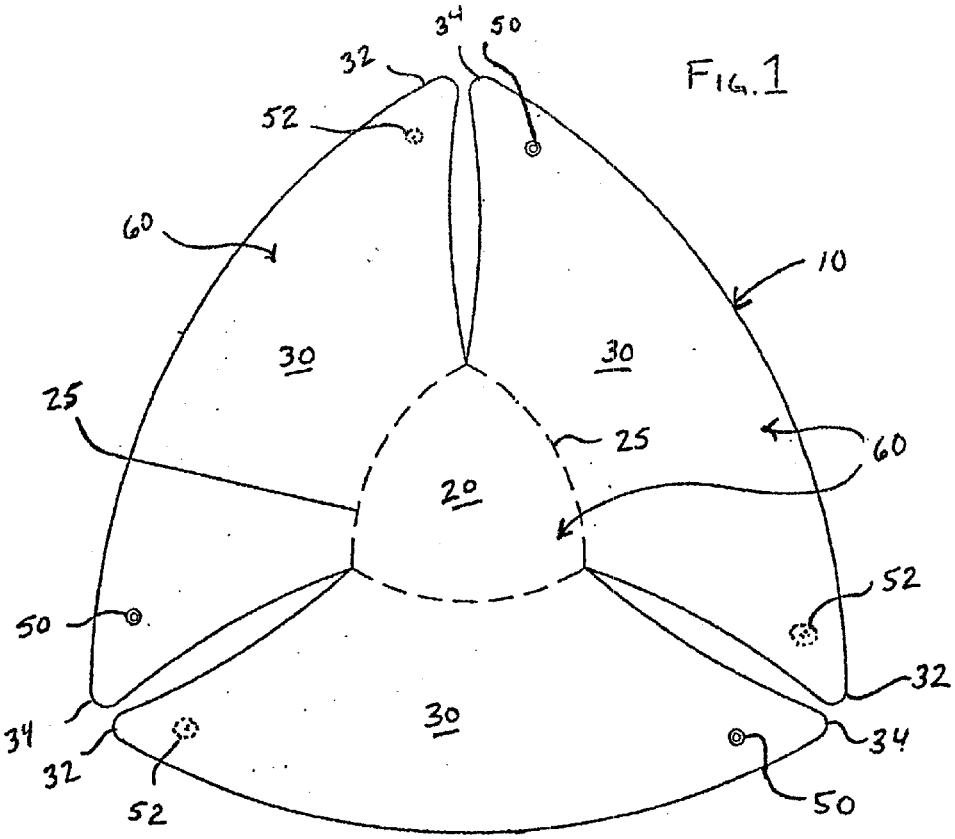
FIG. 1 is a top plan view of a collapsed tray blank of the invention.

Referring now to the drawings, in which like reference numerals are used to refer to the same or similar elements, FIG. 1 shows the top layer 60 of a blank 10 for a collapsible tray of the invention. The blank 10 generally triangular shaped and has a base panel 20 which is triangular with convex sides. A crease 25 separates the base panel 20 from each of three connected side panels 30.

Flexible layer 60 is a single integrated piece of material which includes all side panels 30 and base panel 20. Rigid layer 70, shown in FIG. 2, by contrast, is formed by individual panels 30*a,* 30*b,* 30*c* and 20*a* secured to the flexible layer over a corresponding panel 30, 20.

The side panels 30 have a generally trapezoidal shape, with convex bases and concave sides and top edges. The concave top edges have the same curvature as the sides of the base panel, as only crease 25 separates them.

A fastener 50 is secured to flexible layer 60 adjacent a first base corner 34 of each side panel 30. A corresponding fastener 52 is secured to rigid layer 70 adjacent a second base corner 32 of the side panels 30*a*–30*c*. The fasteners 50, 52 are used to securely hold the blank 10 in its assembled shape while permitting the container to be collapsed again. The fasteners 50, 52 are corresponding pieces of a snap fastener in a preferred embodiment, although it is envisioned that other known types of paired fasteners can be used, including hook and loop fasteners.

Figure 2:
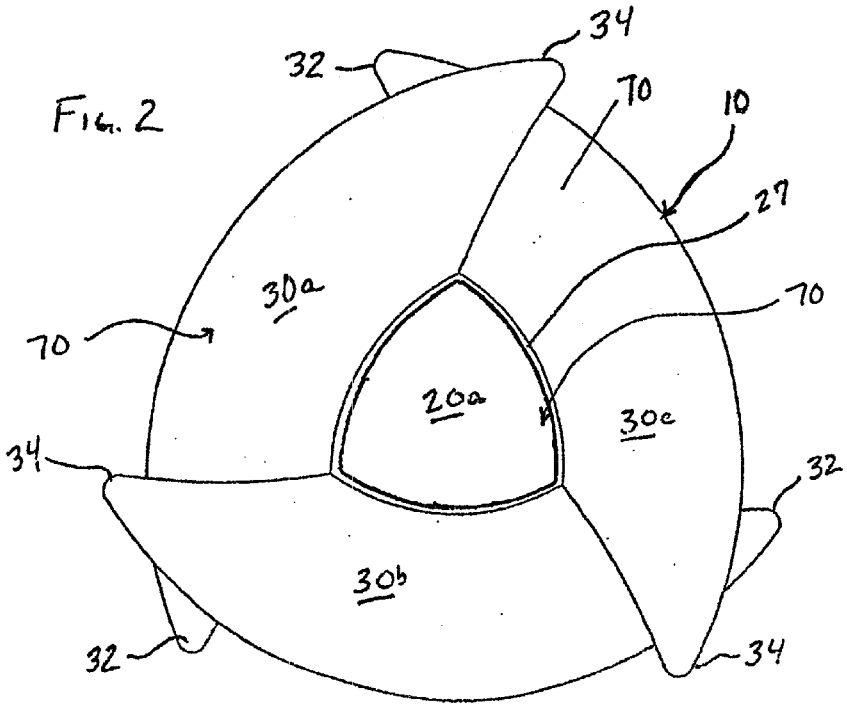
FIG. 2 is a bottom plan view of the tray blank of FIG. 1 in the assembled position.

FIG. 2 shows the blank 10 in one assembled position where rigid layer 70 is on the outside of the container. The rigid side panels 30*a*–30*c* are exposed, and their edges form a small gap 27 with the bottom panel 20*a* where they meet, exposing the flexible layer 60. The narrow gaps 27 between the side panels 30*a,* 30*b,* 30*c* and the base panel 20*a* in the rigid layer 70 effectively define flexible hinges in the flexible layer 60. Since the rigid layer 70 does not bend as easily as the flexible layer 60, the gap 27 is the area of least resistance in the layer 70, and the unfettered flexible layer 60 is provided with an axis for bending.

As seen in the drawing, the blank 10 is assembled into a container by bending side panels 30 of the flexible layer 60 inwardly and overlapping the first and second base corners 34, 32 of adjacent side panels 30 so that the fasteners 50, 52 are aligned for connecting together.

It should be noted that if the fasteners 50, 52 are aligned properly, that the blank 10 can be folded backwards and reversibly assembled, with the rigid layer 70 on the inside and the flexible layer 60 on the outside of the assembled container.

Figure 3A:
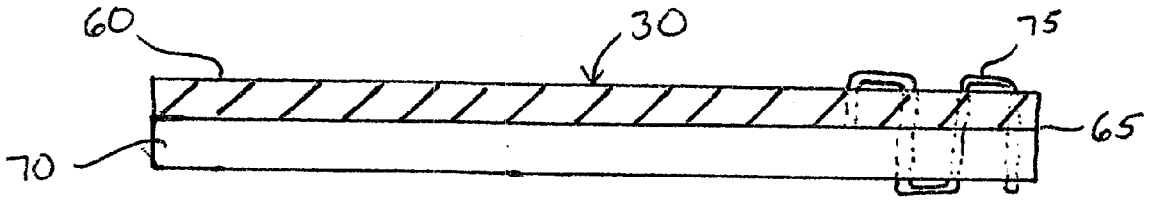
FIG. 3A is a side elevational view of an edge of a panel of the blank of FIG. 1.

FIGS. 3A illustrates the two layers 60, 70 forming the container blank 10. As seen in the drawing, the flexible layer 60 is secured to the rigid layer 70 using an adhesive 65 or stitching 75. When the layers 60, 70 are joined using an adhesive, they are preferably laminated to ensure bonding between layers.

The layers 60, 70 are preferably of similar thicknesses, but their relative thicknesses may vary as well. The flexible layer 60 is 1/64 inch up to about ½ inch thick, although greater thicknesses may be possible, and preferably between 1/64 inch and ¼ inch thick. The flexible layer is most preferably from 1/64 to 1/16 inch thick. The rigid layer 70 is 1/64 inch or more thick, and preferably between 1/16 inch and 1 inch thick.

Figure 3B:
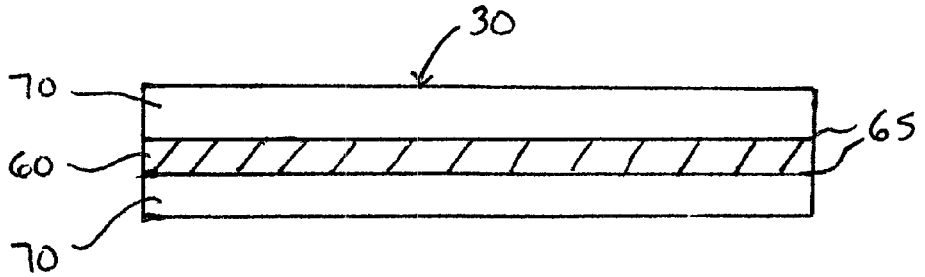
FIG. 3B is a side elevational view of a second embodiment of the panel edge of the blank of FIG. 1.

FIG. 3B illustrates a second embodiment in which two rigid layers 70 are joined to a single flexible layer 60, so that a rigid layer 70 is always exposed. The rigid layers 70 may be laminated to the flexible layer with an adhesive 65, or stitched as when there is only one rigid layer 70.

In a preferred embodiment, the flexible layer 60 is made from a non-woven material, and most preferably from a felt material. The rigid layer 70 is preferably a stiff leather material. Other materials that can be used for each layer include felt, soft leather, fabric, vinyl, cork and other pliable materials for the flexible layer 60. The flexible layer 60 must be easily flexible and capable of being laminated and/or sewn and cut using die-cutting machines. Rigid layer 70 can be formed from a variety of materials which are rigid, although a small amount of bending under force is acceptable, including stiff felt, stiff leather, vinyl, wood, cork and plastics. The rigid layer 70 must be able to provide support and structure to the container and be capable of being sewn and cut with a die-cutting machine.

FIGS. 4–7 illustrate alternative embodiments for the shape of the container and blank 10.

Figure 4:
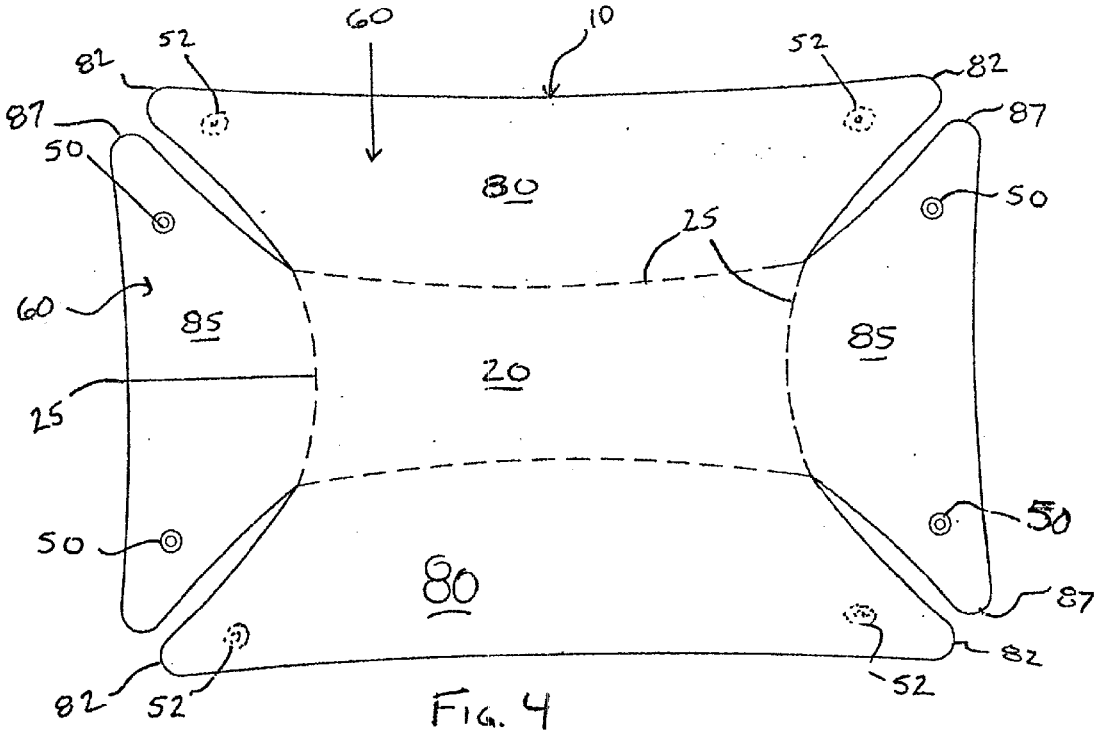
FIG. 4 is a top plan view of another embodiment of a collapsed tray blank according to the invention.
Figure 5:
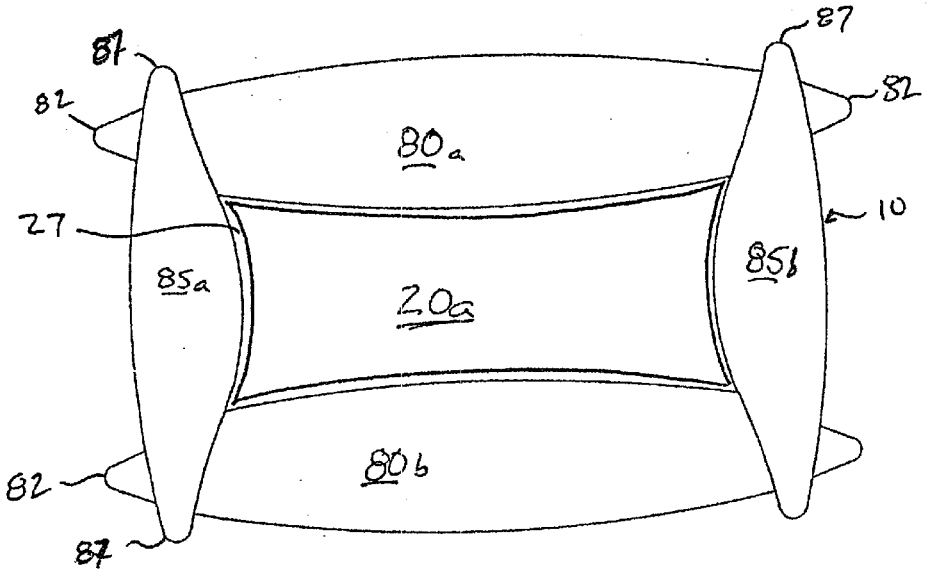
FIG. 5 is a bottom plan view of the blank of FIG. 4 in the assembled position.

FIGS. 4 and 5 show a rectangular blank 10 having flexible layer 60 with rectangular base panel 20, side panels 80 and end panels 85. The rigid layer 70 is formed by base panel 20*a,* side panels 80*a* and 80*b* and end panels 85*a* and 85*b*. Snap fasteners 50, 52 are arranged with one half of each pair at the corners 87 of end panels 85 and the other half at corners 82 of the side panels 80. This arrangement of fasteners 50, 52 results in the container being assembled by having end panel corners 87 overlap both side panel corners 82 at each end of the assembled container. The blank 10 can be assembled inverted as with the triangular blank 10 of FIGS. 1 and 2, by folding the rigid layer panels 80*a,* 80*b,* 85*a* and 85*b* toward the base panel 20*a* and fastening the snap fasteners 50, 52.

Figure 6:
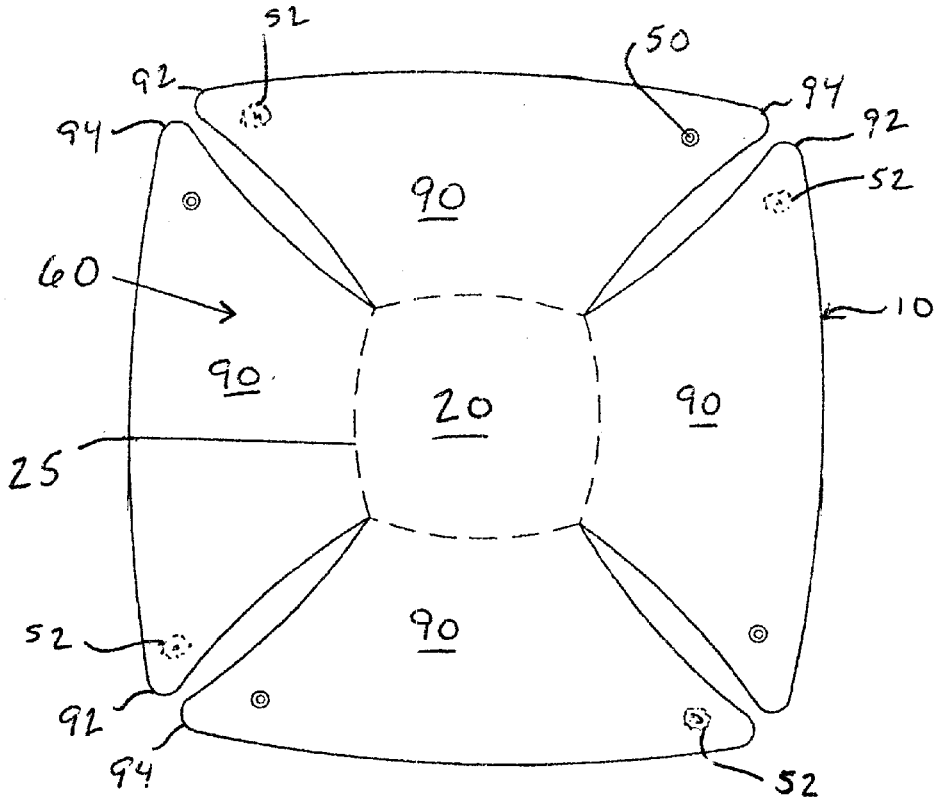
FIG. 6 is a top plan view of a third embodiment of a collapsed tray blank of the invention.
Figure 7:
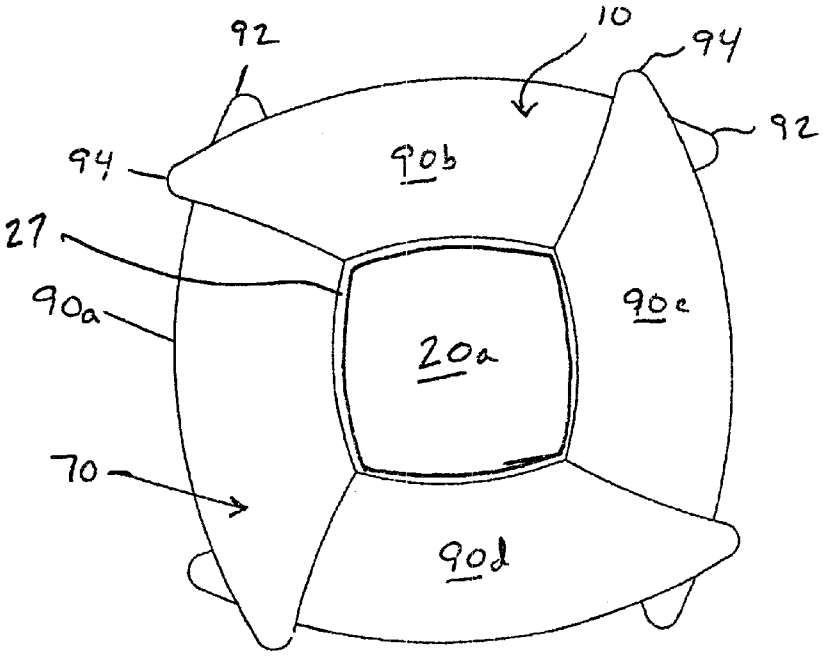
FIG. 7 is a bottom plan view of the blank of FIG. 6 in the assembled position.

The container blank 10 of FIGS. 6 and 7 is for making a square container. The blank 10 has unitary flexible layer 60 forming square base panel 20 and four side panels 90, delineated by crease 25 between each side panel 90 and the base panel 20. Snap fasteners 50, 52 are provided at corners 92, 94 in the same manner as with the embodiment of FIGS. 1 and 2. Rigid layer 70 includes a base panel 20*a* and four side panels 90*a,* 90*b,* 90*c* and 90*d,* all individually connected to the flexible layer by lamination.

The blank 10 of FIGS. 6 and 7 is assembled by overlapping alternating corners 92, 94 of adjacent side panels 90 and fastening snaps 50, 52 when side panels 90 are folded toward base panel 20. The blank 10 can be assembled inverted by folding the side panels 90*a,* 90*b,* 90*c* and 90*d* toward the base panel 20*a* and then fastening fasteners 50, 52.

A preferred method for assembling the blanks 10 is to cut the flexible layer 60, cut rough corresponding rigid layer panels and join them together using lamination. The joined panels 60, 70 may then be die cut again as a single blank in order to conform the edges of each panel. The connection of the laminated panels 60, 70 can be reinforced by stitching them together after conforming the edges. When the layers are laminated together, the die cut edges may be left raw, as the layers do not separate.

While a specific embodiment of the invention has been shown and described in detail to illustrate the application of the principles of the invention, it will be understood that the invention may be embodied otherwise without departing from such principles.

What is claimed is:

1. A blank for a collapsible container, comprising:

a first unitary layer of a flexible material defining a base panel having at least three side panels;

a second layer of a plurality of individual rigid panels, each rigid panel in the second layer corresponding to and shaped the same as one of the side or base panels of the first unitary layer, the rigid panels secured to the flexible material; and fastener means for reversibly and releasably fastening the at least three side panels and rigid panels together to form a tray when the at least three side panels are all folded together in the same direction toward each other, an outside surface of the assembled tray being defined by the first layer or the rigid layer, depending upon the direction in which the at least three side panels are folded together for fastening.

2. A blank according to claim 1, wherein the at least three side panels of the first unitary layer comprise four side panels.

3. A blank according to claim 1, wherein each side panel has a generally trapezoidal shape.

4. A blank according to claim 3, wherein the base panel sides are convex.

5. A blank according to claim 1, wherein the base panel sides are convex.

6. A blank according to claim 1, wherein adjacent edges of the rigid panels define gaps for folding the blank.

7. A blank according to claim 1, wherein the rigid panels of the second layer are secured to the first layer by one of stitching and laminating.

8. A blank according to claim 1, wherein the fastener means comprises a plurality of corresponding pairs of snap fasteners, one of each pair of snap fastener secured to the first unitary layer, the other snap fastener of each pair secured to the second layer.

9. A blank according to claim 1, wherein the flexible material is one of felt, leather, fabric, vinyl and cork.

10. A blank according to claim 9, wherein the flexible material is 1/64 to ½ inch thick.

11. A blank according to claim 10, wherein the rigid panels are made from stiff felt, stiff leather, wood, cork and plastic.

12. A blank according to claim 9, wherein the rigid panels are made from stiff felt, stiff leather, wood, cork and plastic.

13. A blank according to claim 2, wherein the rigid layer is 1/64 to one inch thick.

14. A collapsible container for holding objects, the container comprising:

a first layer of a flexible material having a base panel and at least three flexible side panels, the base panel and flexible side panels formed from the same piece of flexible material;

a plurality of rigid panels, one rigid panel secured to each of the base panel and flexible side panels and forming a discontinuous rigid layer defining hinges in the flexible layer between adjacent edges of the base panel and each rigid panel; and fastener means for reversibly and releasably fastening the at least three flexible side panels and attached rigid panels together to form a tray when the flexible side panels are all folded together in the same direction toward each other, an outside surface of the assembled tray being defined by the first layer or the rigid layer, depending upon the direction in which the flexible side panels are folded together for fastening.

15. A collapsible container according to claim 14, wherein the flexible material is one of felt, leather, fabric, vinyl and cork.

16. A collapsible container according to claim 14, wherein the rigid panels of the second layer are secured to the first layer by one of stitching and laminating.

17. A collapsible container according to claim 14, wherein the rigid panels are made from stiff felt, stiff leather, wood, cork and plastic.

18. A collapsible container according to claim 14, wherein the rigid panels are made from stiff felt, stiffened leather, wood, cork and plastic.

19. A collapsible container according to claim 14, wherein the at least three flexible side panels comprises four flexible side panels.

20. A collapsible container according to claim 14, wherein each flexible side panel has a generally trapezoidal shape.

* * * * *